US005509843A

United States Patent [19]

Akama

[11] Patent Number: 5,509,843

[45] Date of Patent: Apr. 23, 1996

[54] METHOD AND APPARATUS FOR MANUFACTURING NEEDLE SHAPED MATERIALS AND METHOD FOR MANUFACTURING A MICROEMITTER

[75] Inventor: Yoshiaki Akama, Yokohama, Japan

[73] Assignee: Kabushiki Kaisha Toshiba, Kawasaki, Japan

[21] Appl. No.: 246,332

[22] Filed: May 19, 1994

[30] Foreign Application Priority Data

May 19, 1993 [JP] Japan ..... 5-117092

[51] Int. Cl.[6] ..... H01J 1/30; H01J 9/02

[52] U.S. Cl. ..... 445/50; 445/60; 427/583; 427/584; 427/596; 118/723 FI

[58] Field of Search ..... 445/50, 51, 60; 427/582, 583, 584, 596, 562, 564, 526; 118/624, 723 FF, 723 FI

[56] References Cited

U.S. PATENT DOCUMENTS

| | | | |
|---|---|---|---|
| 4,784,963 | 11/1988 | Krimmel et al. | 427/583 |
| 4,876,112 | 10/1989 | Kaito et al. | 118/723 FI |
| 5,064,396 | 11/1991 | Spindt | 445/50 |
| 5,344,352 | 9/1994 | Horne et al. | 445/50 |

FOREIGN PATENT DOCUMENTS

| | | | |
|---|---|---|---|
| 0339951 | 11/1989 | European Pat. Off. . | |
| 1522285 | 8/1969 | Germany . | |
| 61-217576 | 9/1986 | Japan | 427/584 |
| 61-276233 | 12/1986 | Japan | 427/584 |
| 2-228473 | 9/1990 | Japan | 427/584 |
| 2-245602 | 10/1990 | Japan . | |
| 4-249827 | 9/1992 | Japan . | |
| 5-41152 | 2/1993 | Japan . | |
| 5-94762 | 4/1993 | Japan . | |
| WO93/05530 | 3/1993 | WIPO . | |

OTHER PUBLICATIONS

Journal of Vacuum Science & Technology, Part B, vol. 10, No. 6, Nov.–Dec. 1992, pp. 2743–2748, T. H. P. Chang, et al., "Arrayed Miniature Electron Beam Columns for High Throughput Sub–100 nm Lithography".

Journal of Vacuum Science & Technology, Part B, vol. 6, No. 1, Jan.–Feb. 1988, pp. 477–481, H. W. P. Koops, et al., "High–Resolution Electron–Beam Induced Deposition".

Patent Abstracts of Japan, vol. 10, No. 303 (C–378), Oct. 16, 1986, JP–A–61 118 137, Jun. 5, 1986.

*Primary Examiner*—Kenneth J. Ramsey
*Assistant Examiner*—Jeffrey T. Knapp
*Attorney, Agent, or Firm*—Oblon, Spivak, McClelland, Maier & Neustadt

[57] ABSTRACT

A method and apparatus exists for manufacturing needle-shaped materials for use as microemitters, wherein a light beam output from a light source is split into a plurality of beams and the split light beams are focused by an optical system and directed into a chamber having a gas containing electroconductive molecules. The electroconductive molecules are degraded through excitation by the beams directed into the chamber to deposit needle-shaped materials on a substrate disposed in the chamber. By so doing, a plurality of needle-shaped materials are simultaneously produced on the substrate in accordance with a corresponding number of beams obtained through splitting.

17 Claims, 6 Drawing Sheets

METHOD AND APPARATUS FOR MANUFACTURING NEEDLE SHAPED MATERIALS AND METHOD FOR MANUFACTURING A MICROEMITTER

BACKGROUND OF THE INVENTION

1. Field of the Invention

The present invention relates to a method and apparatus for manufacturing emitter electrodes, as needle-shaped materials, to be mounted on a microemitter (electric field emitting element) constituting, for example, one kind of vacuum element and further to a method for manufacturing a microemitter as set out above.

2. Description of the Related Art

Conventionally, research has been made into a vacuum element with a vacuum used as a carrier transportation medium. A microemitter is known as one such vacuum element. As a method for manufacturing such a microemitter, use is made of a method for performing a fine working on it using an etching process or a method for effecting an oblique-incident type deposition of a film forming material by virtue of sputtering.

A Spint- or wedge-type is known as a typical microemitter. In the case of the Spint-type, the emitter electrode assumes a square-pyramidal or conical configuration. In the manufacture of the Spint-type microemitter, a Si substrate is anisotropically or isotropically etched using a square or circular resist mask.

In the Spint-type microemitter, on the other hand, individual emitter electrodes have sharper forward ends than in the wedge-type microemitter, but it is not easy to sharpen the individual emitter electrodes uniformly because it is difficult to set the etching conditions under which a plurality of emitter electrodes are uniformly etched.

Further, the smaller the apex angle of the emitter electrode, the more effectively an emission current is emitted. In the case where the emitter electrode is manufactured using the anisotropic etching, it is not possible to freely sharpen the emitter electrode because the apex angle is determined in its face-orientation position. It is also difficult to control the apex angle when the emitter electrode is manufactured using the isotropic etching.

In the wedge-type microemitter, on the other hand, the sharpening of the apex depends upon the accuracy with which patterning is performed with an etching mask (for example, a resist mask). Therefore, the sharpening of the apex is restricted by the resolution of a patterning device.

SUMMARY OF THE INVENTION

It is accordingly the object of the present invention to provide a method and apparatus for readily manufacturing sharpened needle-shaped materials and, further, to provide a method for manufacturing a microemitter having emitter electrodes as needle-shaped materials.

According to one aspect of the present invention, a method for manufacturing needle-shaped materials on a substrate located in a hermetically sealed atmosphere, comprising the steps of:

splitting an excitation beam into a plurality of beams;

focusing the respective beams and directing these beams into that hermetically sealed atmosphere where electroconductive molecules are present; and degrading the electroconductive molecules through excitation by the respective beams directed into the hermetically sealed atmosphere to enable needle-shaped materials to be deposited on the substrate.

According to another aspect of the present invention, an apparatus for manufacturing needle-shaped materials, as deposited materials, on a substrate by degrading electroconductive molecules in an atmosphere through excitation by an excitation beam, comprising:

a source for outputting that excitation beam;

splitting means foe splitting the excitation beam which is output from the source into a plurality of beams;

focusing means for focusing these beams obtained through splitting; and a chamber in which the electroconductive molecules and substrate can be held therein and where the beams focused by the focusing means are directed onto the substrate to allow needle-shaped materials to be deposited on the substrate.

According to another aspect of the present invention, a method for manufacturing an electric field emission element having a plurality of needle-shaped emitter electrodes on an array substrate, comprising the steps splitting an excitation beam into a plurality of beams;

focusing these beams obtained through splitting and directing the beams into a hermetically sealed atmosphere containing electroconductive molecules; and degrading the electroconductive molecules through excitation by the respective beams directed into the hermetically sealed atmosphere and forming needle-shaped materials, as deposited materials, on the array substrate to provide emitter electrodes.

According to the method and apparatus for manufacturing the above-mentioned microemitter, many needle-shaped materials can be formed on the substrate at a time (i.e., concurrently).

According to the microemitter manufacturing method, it is possible to manufacture a microemitter with many emitter electrodes formed on a substrate, the emitter electrodes having highly similar forward ends whose curvature radiuses are small.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The embodiments of the present invention will be explained below with reference to the accompanying drawings.

Figure 1:
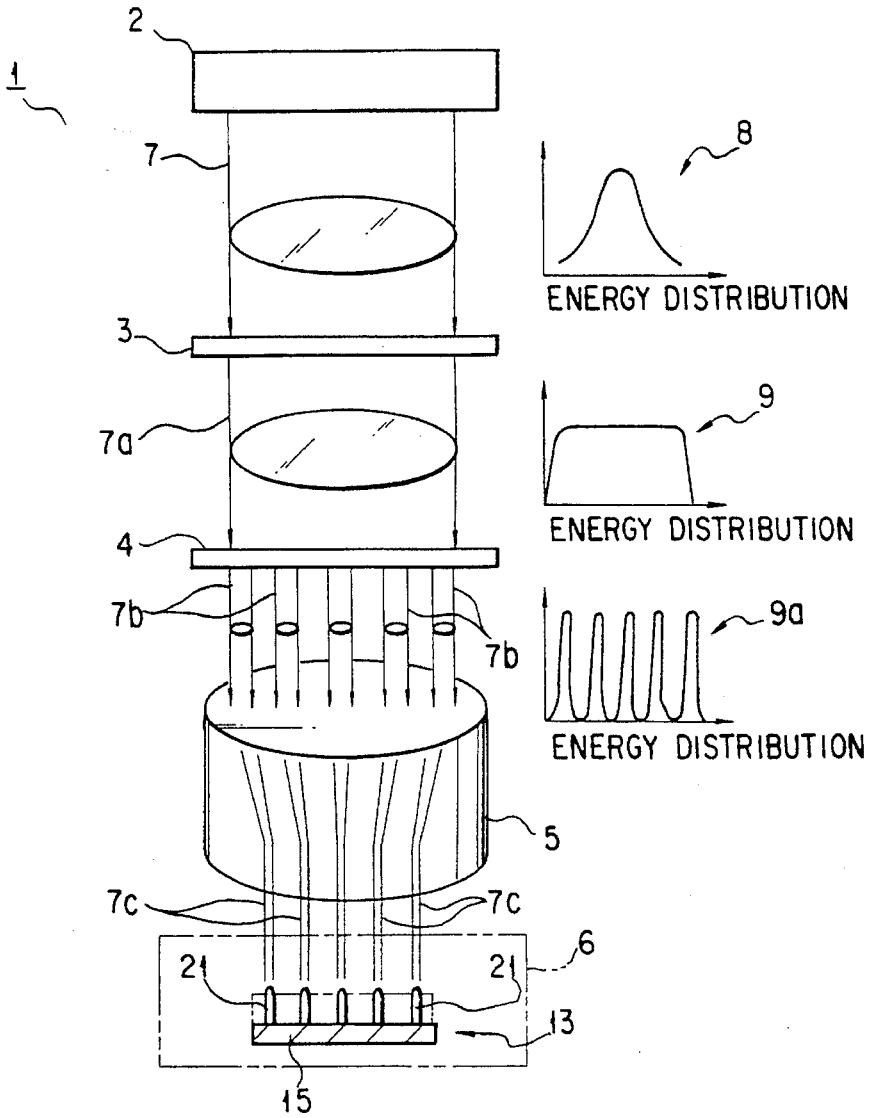
FIG. 1 is a diagrammatic view showing an emitter electrode manufacturing apparatus according to a first embodiment of the present invention.

FIGS. 1 to 8 show a first embodiment of the present invention. Reference numeral 1 in FIG. 1 shows an apparatus for manufacturing emitter electrodes (needle-shaped materials) for a microemitter. The emitter electrode manufacturing apparatus i includes a light source 2, first optical system 3, beam splitting plate 4, second optical system 5 and chamber 6.

The light source 2 is comprised of a laser device, such as excimer laser or YAG laser, or a silver lamp, and outputs a light beam 7 as an excited beam. The light beam 7 constitutes a circular beam of adequately large size having an adequately high power of energy. In the case where any large-size light beam 7 cannot be output from the light source 2, the beam has only to be expanded using a beam expander.

The light beam 7 output from the light source 2 takes on an energy distribution (light intensity distribution) with a peak level emergent at a center area relative to its edge areas, the Gaussian distribution, as shown in a graph 8 on the top side in FIG. 1.

The first optical system 3 allows the light beam 7 to take on an energy distribution of substantially uniform level in the cross-sectional area of the light beam as shown in a graph 9 on the middle side in FIG. 1. For example, an ordinary Gaussian compensating plate, Kaleidoscope, etc., are used as the first optical system.

Figure 2:
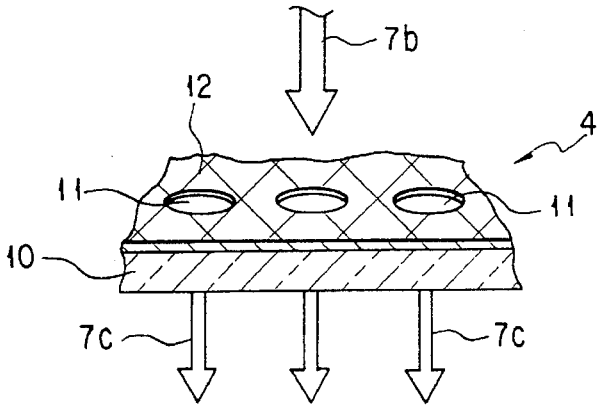
FIG. 2 is an explanative view showing the function of a mask substrate in FIG. 1.

The beam splitting plate 4 is of such a type that, as partly shown in FIG. 2, a light shielding film 12 is patterned on a glass plate 10 with a plurality of circular holes formed therein. The glass plate 10 has a light transmitting property for allowing the light beam **7*a* which comes from the light source 2 to be transmitted there-through. The circular holes 11** are regularly arranged so as to correspond to an array of emitter electrodes to be manufactured.

Part of the light beam **7*a* reaching the beam splitting plate 4 past the first optical system 3 is shielded by the light shielding film 12. The light beam 7*a* landed on the glass plate 10 via the circular holes 11 passes through the glass plate 10. That is, the light beam 7*a* having its energy distribution made uniform through the first optical system 3 is divided into a plurality of light beams 7*b* and they are incident, as parallel beams, on the second optical system 5. At that time, the respective light beams 7*b* encounter diffraction at the edge portions of the circular holes 11 of the beam splitting plate 4. For this reason, the energy intensity distribution of the respective light beams passed through the corresponding holes 11 of the beam splitting plate 4 have the Gaussian energy distribution with each peak level emergent at the center relative to the edge areas as shown in a graph 9*a* on the bottom side in FIG. 1**.

The second optical system 5 is comprised of a combination of lenses, etc., and enables the diameters of the light beams **7*b*, as well as the distances between the respective adjacent light beams 7*b*, to be reduced at a predetermined rate. The respective light beams 7*c* exiting from the second optical system 5 enter the chamber 6 where a substrate 13 for a microemitter array, as will be set out below, is positioned and exposed with the light beams 7*c***.

Figure 3:
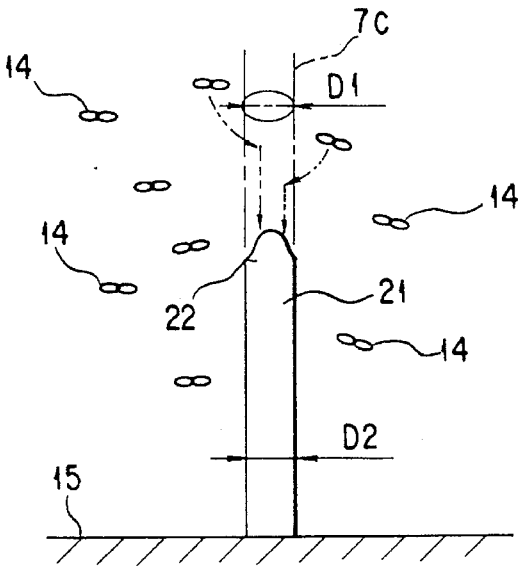
FIG. 3 is an explanatory view showing a principle on which an emitter electrode is manufactured.

The chamber 6 is evacuated, by a pump not shown, to a vacuum state and a gas containing predetermined electroconductive molecules, such as $WF_6$, is introduced into the chamber 6. As shown in FIG. 3, those electroconductive molecules 14 in the chamber 6 are broken down through excitation by the light beams **7*c* incident into the chamber 6**.

Figure 5A:
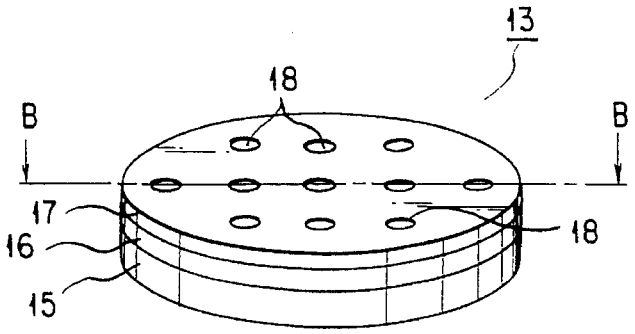
FIG. 5A is a perspective view showing a substrate for a microemitter array.
Figure 5B:
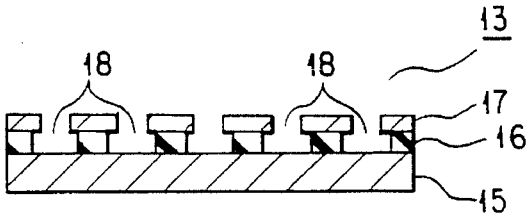
FIG. 5B is a cross-sectional view taken along line B—B in FIG. 5A.

As shown in FIGS. 5A and 5B, the substrate 13 (hereinafter referred to as an array substrate) for a microemitter array is comprised of an Si substrate 15 with an insulating film 16 and electroconductive film 17 formed thereon as a stacked structure. In this embodiment, $SiO_2$ is used as a material for the insulating film 16 and WSi is a material for the electroconductive film 17.

The Si substrate 15 is truely circular in configuration and the Si substrate structure has its surface planarized with high accuracy. A plurality of cavities 18 are provided in the array substrate 13 for the manufacture of emitter electrodes and arranged in regular array. The cavities 18 are opened relative to the electroconductive film 17 in a truly circular outline. Further, the cavities 18 extend through the electroconductive film 17 and insulating film 16 with their bottoms opened to the surface of the Si substrate 15.

The above-mentioned array substrate 13 is manufactured as shown in FIGS. 6A to 6E.

Figure 6A:
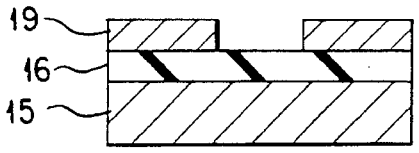
FIG. 6A is an explanatory view showing a step of manufacturing a substrate for the microemitter array.
Figure 6D:
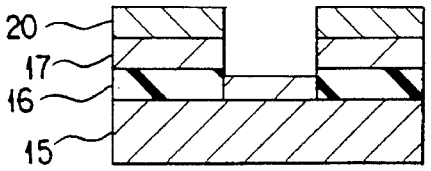
FIG. 6D is an explanatory view showing another step of the manufacturing process.
Figure 6B:
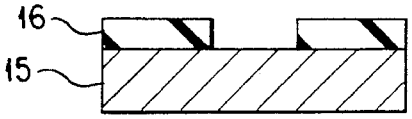
FIG. 6B is an explanatory view showing another step of a manufacturing process.

A mask having a substantially true-circular resist pattern with a plurality of holes of a substantially true-circular configuration is employed for the manufacture of the array substrate 13. In accordance with the number of the emitter electrodes to be manufactured, a corresponding number of such holes are provided in the resist pattern at intervals corresponding to those of the cavities 18. First, anisotropic etching is performed using the resist pattern 19 as a mask as shown in FIG. 6A and the insulating film 16 is formed to a configuration as shown in FIG. 6B.

Figure 6E:
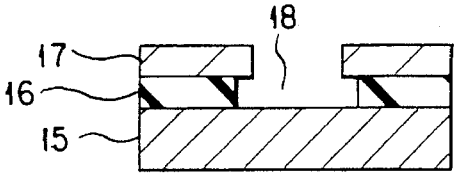
FIG. 6E is an explanatory view showing another step of the manufacturing process.
Figure 6C:
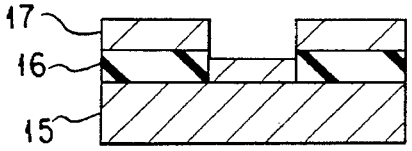
FIG. 6C is an explanatory view showing another step of the manufacturing process.

As shown in FIG. 6C, an electroconductive film 17 is formed by a means, such as sputtering or CVD. At that time, the electroconductive film 17 is also formed on that surface of the Si substrate 15 which is exposed from the insulating film 16. Then a resist 20 is patterned as shown in FIG. 6D except for an area covered with the electroconductive film 17 overlying the Si substrate 15.

After patterning, the electroconductive film 17 is anisotropically etched and the insulating film 16 isotropically etched to a form as shown in FIG. 6E.

Explanation will be given below about the aforementioned emitter electrode manufacturing apparatus 1 as well as the method for manufacturing emitter electrodes on the array substrate 13.

A light beam 7 output from the light source 2 passes through the first optical system 3 and has its energy distribution converted from the Gaussian distribution as plotted in the graph 8 in FIG. 1 to the uniform distribution as plotted in the graph 9 in FIG. 1. This conversion is so conducted that, when a light beam 7*a* is split into a plurality of light beams, the respective split light beams 7*b* may have their energy distribution take on the substantially uniform Gaussian distribution.

The light beam 7*a* exiting from the first optical system 3 is split by the beam splitting plate 4 into a plurality of light beams. When the light beam 7*a* passes through the circular holes 11 in the beam splitting plate 4, diffraction occurs at the edge areas of the circular holes 11. By so doing, the light beams 7*b* passing through the circular holes 11 have their intensities more weakened at the edge areas than at the center areas of the circular hole in the beam splitting plate 4 so that the energy distribution of the respective split light beams 7*b* have the Gaussian distribution.

The respective split light beams 7*b* leaving the beam splitting plate 4 enter the second optical system 5, while maintaining their intensity distribution as they are, so that the beam diameter as well as the distance between the adjacent light beams 7*b* is reduced. The respective light beams 7*c* are incident into the chamber 6 and illuminate an array substrate 13 held in the chamber 6. That is, each light beam 7*c* illuminates a center area of a corresponding one of the cavities 18 of the array substrate 13 in a direction vertical to the Si substrate 15.

Figure 7:
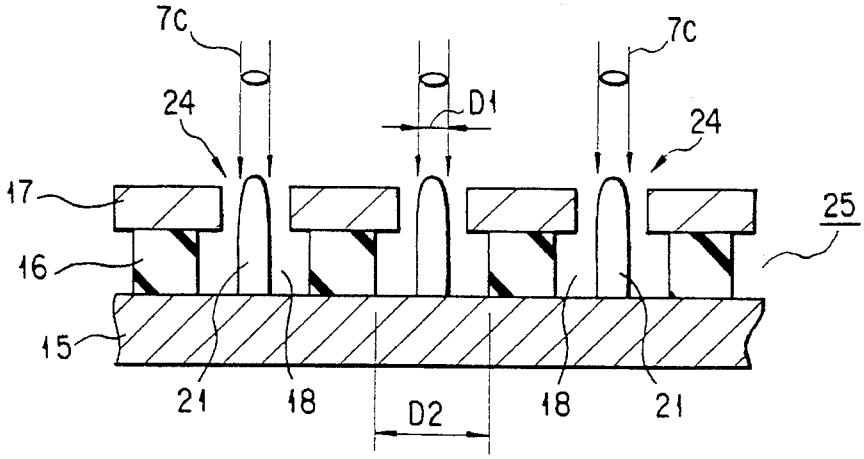
FIG. 7 is an explanative view showing the manner in which emitter electrodes are manufactured on a substrate for a microemitter array.

As shown in FIG. 7, the respective light beams 7*c* are directed at the corresponding cavities 18 of the array substrate 13 and the beam diameter $D_1$ of the respective light beam 7*c* is set to be smaller than the diameter $D_2$ of the respective cavity 18.

A gas containing electroconductive molecules 14 is introduced into the chamber 6 and, as shown in FIG. 3, the electroconductive molecules 14 in the gas atmosphere, including tungsten (W) in this embodiment, are degraded through excitation by the light beams 7*c*. Of the electroconductive molecules, tungsten is deposited on the Si substrate 14 along the light beams 7*c*.

Through continued illumination by the light beams 7*c* on the Si substrate 15, a respective deposit is grown gradually. The area on which tungsten atoms of the electroconductive molecule 14 are deposited is restricted to an area at which the respective light beam 7*c* is directed for illumination. As a result, emitter electrodes 21 are formed as filament- or needle-shaped deposits on the Si substrate 15, the needle-shaped deposit serving as a needle-shaped electrode.

Since, in this way, many light beams 7*c* originating from one light beam 7 are illuminated on the Si substrate 15 via the respective cavities 18, it is possible to manufacture many emitter electrodes 21 on the substrate at a time. For those light beams 7*c* having their energy distribution take on the Gaussian distribution, given their energy integration values to be equal to each other, the smaller their half-width, the sharper the emitter electrodes 21 become.

The cross-sectional shape of the respective emitter electrode 21 is formed as a true circular configuration corresponding to the spot size of the light beam 7*c*, that is, the diameter $D_2$ of the emitter electrode 21 substantially coincides with the beam diameter $D_1$ of the light beam 7*c*. The length of the respective emitter electrode 21, that is, the height of the emitter electrode 21 projected from the Si substrate 15, is increased in proportion to the illumination time of the light beam 7*c*.

Figure 4A:
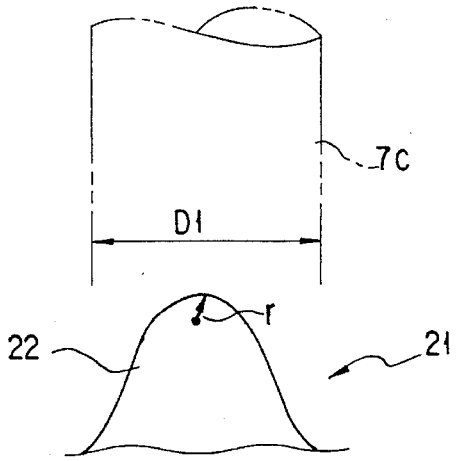
FIG. 4A is an explanatory view showing a relation of the shape of the forward end of the emitter electrode to the energy density distribution of a light beam.
Figure 4B:
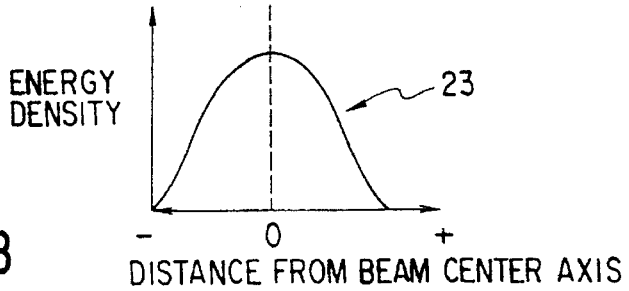
FIG. 4B is an explanatory view showing a relation of the shape of the forward end of the emitter electrode to the energy density distribution of a light beam.

The shape of a forward end 22 of the emitter electrode 21 as shown in FIG. 3 has a correlation to the energy density distribution of the light beam 7*c*. Stated in another way, the curvature radius $\gamma$ of the forward end 22 of the emitter electrode 21 as shown in FIG. 4A has a substantially similar relation to the curvature of an energy density distribution curve 23 of the light beam 7*c* as shown in FIG. 4B. Further, the curvature radius $\gamma$ of the forward end 22 of the electrode 21 is about 1/10 the beam diameter $D_1$ of the light beam 7*c*.

Thus the curvature radius $\gamma$ of the forward end 22 of the emitter electrode 21 can be made adequately small by condensing, with the second optical system 5, the light beam 7*c* whose energy distribution takes on the Gaussian distribution. In this embodiment, the curvature radius $\gamma$ of the forward end 22 of the electrode 21 can be set to be smaller than, for example, 1000 Å.

In this way, the emitter electrodes 21 are formed on the array substrate 13 at the positions corresponding to the cavities 18. As shown in FIG. 7, the respective emitter electrodes 21 constitute microemitters 21 and a plurality of microemitters 24 constitute one microemitter array 25. The number of microemitters 24 formed on one microemitter array 25 is determined by the number of the circular holes 11 in the beam splitting plate 4 and the size (diameter) of the light beam 24.

The respective microemitters 24 can be formed at a high-density interval by reducing the distance between the circular holes 11 of the beam splitting plate 4 or enlarging the aperture angle of the second optical system 5.

As a means for splitting the light beam 7*a* use may be made of an optical fiber and lens instead.

According to the method for manufacturing emitter electrodes, the following advantages can be obtained in comparison with the conventional method for manufacturing emitter electrodes.

(1) The similarity of the forward end shapes of many emitter electrodes to each other.

In the conventional emitter electrode manufacturing method, the shape accuracy of the emitter electrodes depends upon the accuracy with which the mask patterning is performed. It is, therefore, difficult to manufacture many emitter electrodes of uniform shape. In the case where there is a variation in the shape of the respective emitter electrodes, different emission current levels are involved even if the same electric field is applied to these emitter electrodes.

According to the method of the present invention, the shapes of the forward ends 22 of the emitter electrodes 21 depend upon the energy distribution of the respective light beams 7*c* obtained through the beam splittering plate 4. The respective light beams 7*c* are obtained by making uniform the energy distribution through the first optical system 3 and then splitting the light beam 7*a* into light beams 7*b* through the beam splitting plate 4.

Since the energy distribution of the respective light beams 7*c* is not affected by the patterning accuracy of the beam splitting plate 4, it is possible to manufacture, on the substrate, many emitter electrodes 21 at a time which each have a sharp forward end. The light beam 7, being passed through the first optical system 3 and beam splittering plate 4, is provided as light beams 7*b* and the array substrate 13 is exposed with light beams 7*c* passed through the second optical system 5. As a result, emitter electrodes 21 of uniform shape can be obtained without involving less shape accuracy and it is also possible to achieve the high similarity with which the shapes of the one-end sides of the respective emitter electrodes 21 are formed.

(2) Field effect emission characteristic

In general, those requirements necessary to enhance emission current are: the small apex angle of the emitter electrode, proper extent to which the forward end of the emitter electrode is projected from a gate electrode, that is, the second electroconductive film 17 in this embodiment, small curvature radius of the forward end of the emitter electrode. In a conventional Spint-type microemitter, the emitter electrode has a greater apex angle and, in addition, the forward end of the emitter electrode cannot be projected clear of the gate electrode. It is also difficult to emit an electron just above in a conventional wedge-type microemitter.

According to the method of the present invention, the curvature of the forward end 22 of the emitter electrode 21 can be controlled by the energy distribution of the light beam 7*c* and it is possible to facilitate the easiness with which the forward end 22 of the emitter electrode 21 is sharpened. Further, the length of the emitter electrode 21 is determined by the illumination duration time of the light beams 7*c* and it is possible to easily project the emitter electrode 21 clear of the electroconductive film 17. It is possible to readily obtain a high emission current releasing efficiency and a high-level emission current.

(3) Emission current density

In general, the higher the emission current density, the greater the number of the emitter electrodes in a predetermined range. In the conventional microemitter, it is difficult to make those emitter electrodes closer to each other because there is a restriction on the micro-miniaturization of the apex angle of the emitter electrode. Further, an emission current is also restricted by the distance at which the adjacent emitter electrode is located. For the case of the Spint-type microemitter, the greater the distance between the substrate and the gate electrode, the higher the emission current, so that the emitter is so set as to have a greater bottom and hence a greater distance is required between the forward-end sides of the adjacent emitter electrodes.

According to the method of the present invention, the emitter electrode 21 is filament- or needle-shaped in shape and the curvature radius of the forward end 22 of the emitter electrode 21 can be set to be smaller than 1000 Å. For this reason, the distance between the adjacent emitter electrodes 21 can be made nearer to the patterning limitation of the electroconductive film, that is, be made adequately smaller than in the conventional apparatus, so that it is possible to obtain high emission current.

(4) Processability

According to the method of the present invention, no etch-back is required after the emitter electrodes have been manufactured, thus requiring less manufacturing process steps. Since the respective beam 7*c* is conducted to each corresponding cavity 18 of the array substrate 13, it is possible to manufacture emitter electrodes 21 irrespective of the depth of the cavity 18 and hence to form the emitter electrodes 21 at those high aspect ratio areas.

Various changes or modifications of the present invention can be made without departing from the spirit and scope of the present invention.

In the above-mentioned embodiment, although the beam 7*a* is split by the light splitting plate 4 into the light beams 7*b*, the same effects can be achieved using lenses or optical fibers corresponding in number to the aforementioned circular holes 11 in place of the beam splitting plate 4. In this case, the energy distribution of the light beams 7*b* takes on the Gaussian distribution.

Although, in the above-mentioned embodiment, tungsten is employed in connection with the electroconductive molecule, various electroconductive molecules can be used if being degradable through excitation. In the case where an oxide of rhenium (Re) for example is employed as an electroconductive molecule, it can be deposited as needle-shaped materials on the substrate without being deposited on the inner wall of the chamber 6, because Re is hardly reacted with other materials.

Figure 9:
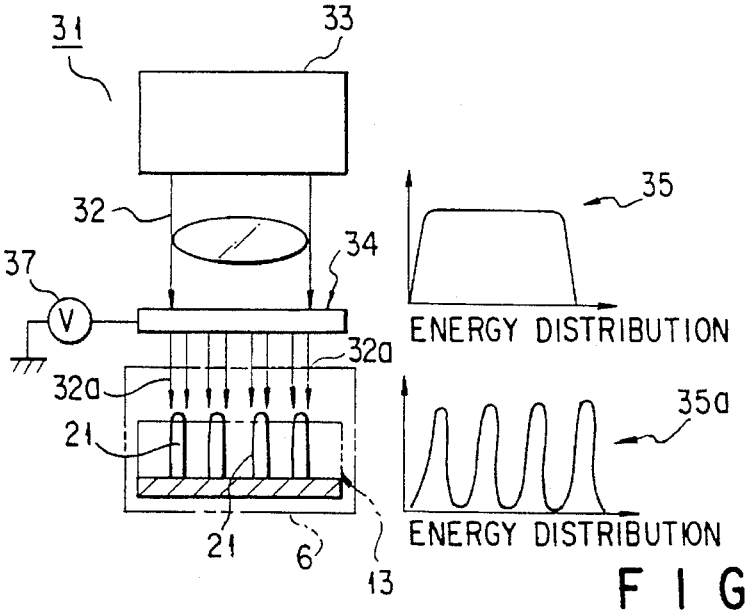
FIG. 9 is a diagrammatic view showing a method for manufacturing emitter electrodes of a second embodiment of the present invention.
Figure 10:
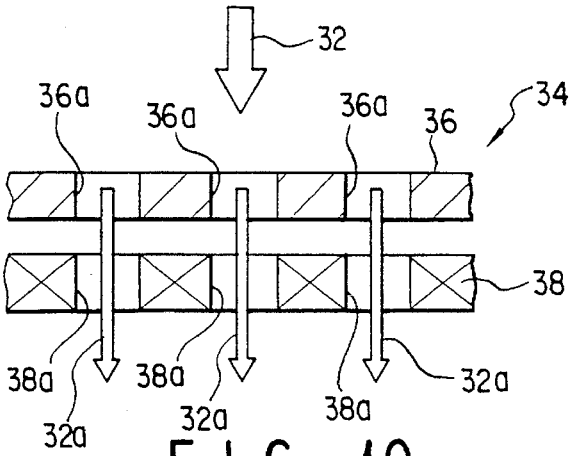
FIG. 10 is an explanatory view for splitting an ion beam.

In the present embodiment, although the light beam 7 is used as an excitation beam, an ion beam 32 may be employed as in an apparatus 31 according to a second embodiment of the present invention as shown in FIG. 9 for example. The apparatus 31 is equipped with an ion beam source 33 and ion beam splitting/focusing unit 34. The aperture of the ion beam 32 is set to be adequately large and the beam energy is set to be adequately high. Further, the energy distribution (ion energy distribution) of the ion beam 32 is substantially uniform as shown in a graph 35 in FIG. 9. The ion beam splitting/focusing unit 34 comprises, as partly shown in FIG. 10, a beam splitting plate 36 with a plurality of circular through holes 36*a* and an electric field- or an electromagnetic type object lens plate 38 disposed on the light transmitting side of the beam splitting plate 36. A plurality of through holes 38*a* are provided in the object lens plate 38 so as to correspond to the through holes 38*a*.

The through holes 36*a* are situated in a regular array so as to correspond to an emitter electrode array to be manufactured. A power source 37 is connected between the beam splitting plate 36 and the object lens plate 38. The ion beams 32 passing through the through holes 36*a* are accelerated or deceterated in accordance with a voltage level applied. The object lens plate 38 focuses respective ion beams 32a passing through the corresponding through holes 38*a*.

The ion beam 32, passing through the circular holes 36*a* in the beam splitting plate 36, is split into a plurality of ion beams. The split ion beams 32 take on the Gaussian intensity distribution as shown in a graph 35*a* in FIG. 9 and, through the respective through holes 38*a* in the object lens plate 38, are focused and enter the chamber 6 where these beams reach the array substrate 13. The ion beams 32*a* illuminate the Si substrate 15 and, in a gas containing electroconductive molecules 14, tungsten is deposited at the illuminated areas on the Si substrate 15 so that many emitter electrodes 21 can be manufactured on the Si substrate at a time.

As the ion beam source 33 use may be made of, for example, a Kaufmann type ion source.

Figure 11:
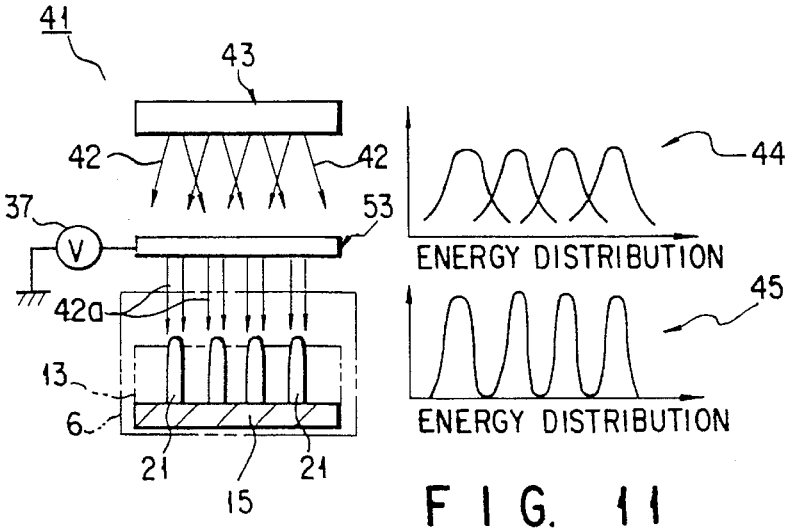
FIG. 11 shows a modified method for manufacturing emitter electrodes of a third embodiment of the present invention.
Figure 12:
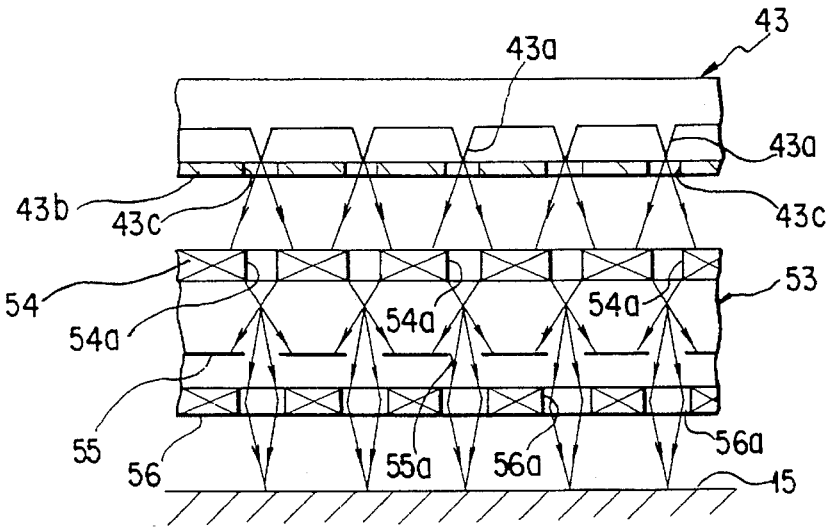
FIG. 12 is an explanatory view showing the splitting of an electron beam into a plurality of beams.

FIG. 11 shows an apparatus 41 according to a third embodiment of the present invention. In this apparatus 41, electron beams 42 are used as excitation beams. The apparatus 41 includes, as shown in FIG. 12, an electronic beam source 43 for emitting a plurality of electronic beams 42 as well as a beam condensing lens system 53. The electronic beam source 43 has a plurality of cathodes 43*a*. The electronic beams 42 are emitted from the corresponding cathodes 43*a* and are incident on the lens system 53 via through holes 43*c* provided in the control plate 43*b* of the electron beam source 43.

The beam condensing lens system 53 comprises a focusing lens section 54 having through holes 54*a* for focusing incident beams 42, aperture plate 55 having aperture holes 55*a* for allowing the passage of a given portion of the respective electron beam 42 exiting from the focusing lens section 54, and object lens section 56 having focusing holes 56*a* for focusing respective electron beams 42 passing through the aperture plate 55. The focusing lens section 54 and object lens section 5 may be of an electric field, a magnetic field- or an electromagnetic field-type and are connected to a power supply 37 as shown in FIG. 11.

The energy distribution of the electronic beam 42 emitted from the respective cathode 43*a* has the Gaussian distribution as shown in a graph 44 in FIG. 11 and, since the electron beam 42 is focused through the focusing lens section 54, the Gaussian distribution with a small half width is obtained as indicated in a graph 45 in FIG. 11.

The respective electronic beams 42*a* exiting through the light condensing lens system 53 enter the chamber 6 where, of a gas including electroconductive molecules, electroconductive molecules are degraded through excitation to allow tungsten to be deposited on an Si substrate so that many emitter electrodes 21 are formed on the Si substrate 15 at a time.

In this embodiment, use may be made, as the electron beam source 43, of a source for emitting a single electron beam. In this case, the single electron beam emitted from the electron beam source 43, being converted to an uniform energy distribution through an electrostatic lens (not shown), is split into a plurality of electron beams 42*a*.

Further, if the electron beam 42, being decelerated, is directed into the chamber 6, it is possible to prevent an adverse effect caused by a high energy electron beam, such as a bounce of the electron beam.

Figure 13A:
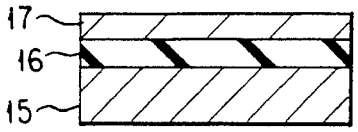
FIG. 13A is an explanatory view showing one step of a method for manufacturing a substrate for a microemitter array of a fourth embodiment of the present invention.
Figure 13C:
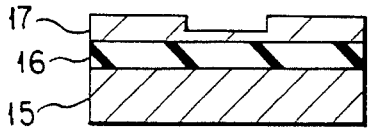
FIG. 13C is an explanatory view showing another step of the manufacture of the substrate.
Figure 13B:
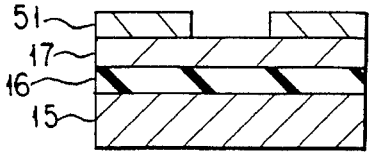
FIG. 13B is an explanatory view showing another step of the manufacture of the substrate.
Figure 13D:
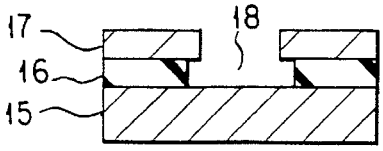
FIG. 13D is an explanatory view showing another step of the manufacture of the substrate.

FIGS. 13A to 13D show a modified method for the manufacture of an array substrate 13 as corresponding to a fourth embodiment of the present invention. In the present method of this invention, an insulating film 16 and electroconductive film 17 are formed in that order over an Si substrate 15 as shown in FIG. 13A and then a resist pattern 51 is aligned on the resultant structure as shown in FIG. 13B. Then the electroconductive film 17 is anisotropically etched as shown in FIG. 13C and the insulating film 16 is isotropically etched as shown in FIG. 13D.

It may be considered that, when anisotropic etching is performed, the resist pattern 51 will disappear during that etching, but, if the electroconductive film 17 is initially so formed as to be rather thick, it is possible to utilize the conductive film 17 as a mask.

Figure 14:
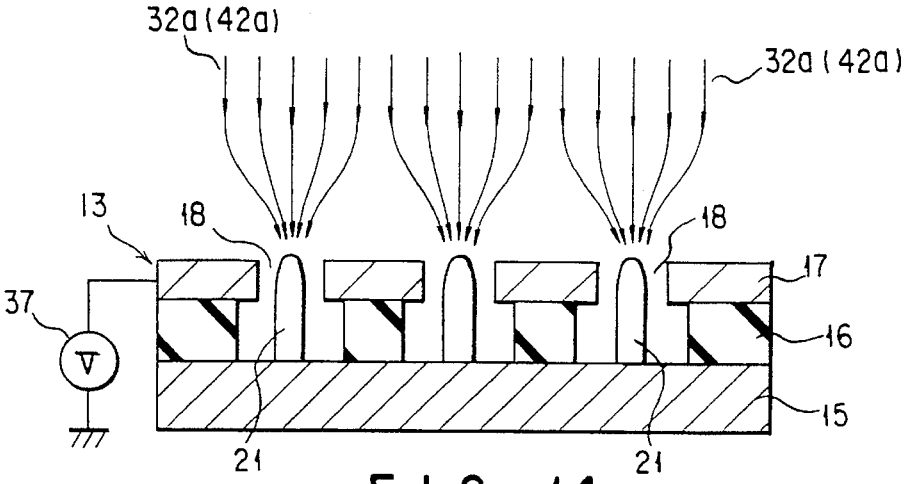
FIG. 14 is an explanatory view showing a method for manufacturing emitter electrodes of a fifth embodiment of the present invention.

FIG. 14 shows a fifth embodiment according to the present invention. In this embodiment, a power supply 37 is connected to an electroconductive film 17 to apply a voltage there. By so doing, an excitation beam, such as an ion beam 32*a* or an electron beam 42*a*, is focused in a corresponding one of cavities 18 of an array substrate 13. In this case, the excitation beam can be accurately focused at the corresponding cavity 18. It is, therefore, possible to facilitate the easiness with which alignment is made relative to the array substrate 13 and to ensure improved productivity.

Figure 15:
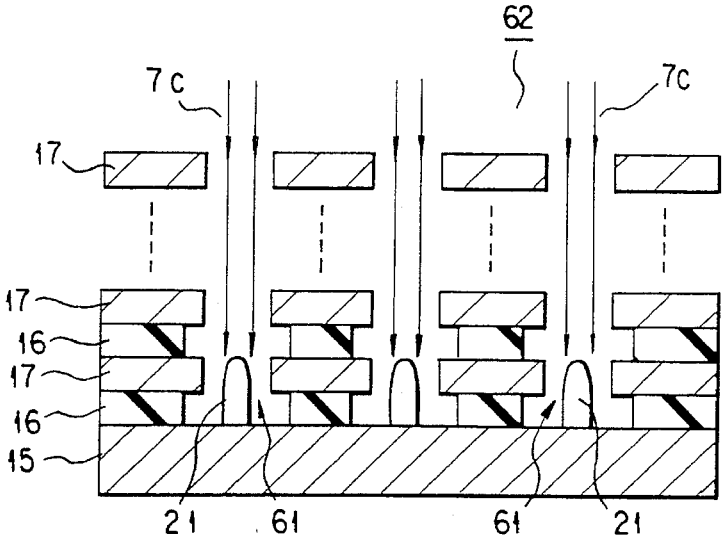
FIG. 15 is an explanatory view showing a method for manufacturing a multielectrode vacuum tube of a sixth embodiment of the present invention.

FIG. 15 shows a sixth embodiment of the present invention. In this embodiment, a plurality of insulating films 16 and plurality of electroconductive films 17 are so formed in an alternate, superimposed relation as to provide needle-shaped emitter electrodes. According to this manufacturing method, it is possible to obtain a multielectrode vacuum tube 61 and multi-electrode vacuum array 62.

Figure 8:
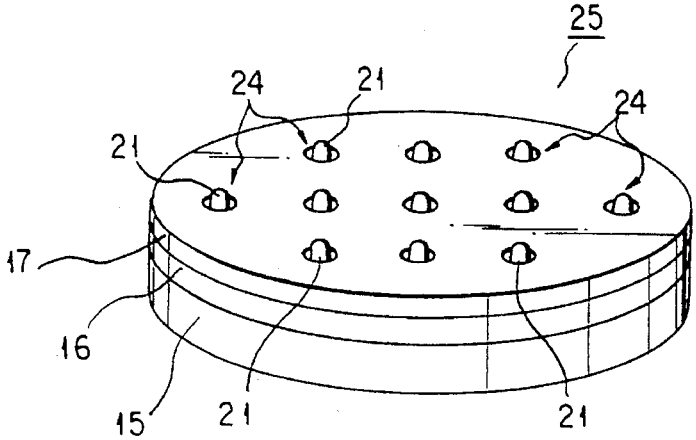
FIG. 8 is a perspective view showing the microemitter.

Further, many sets of microemitters 25 can be combined as a two-electrode vacuum tube array unit so that it can be employed as a power supply source for a flat-screen display device. In this case, the microemitter array is of such a type as shown in FIG. 8 and the two-electrode vacuum tube array may be arranged for each small area of the flat-screen display so that a phosphor screen is light-emitted through the scanning of these respective small area by an electron beam.

The multi-electrode vacuum tubes 61 as shown in FIG. 15 can also be utilized as a power source for a scanning electron microscope.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A method for manufacturing needle-shaped materials on a substrate, comprising the steps of:

focusing a plurality of excitation beams and introducing these excitation beams into a hermetically sealed atmosphere where electroconductive molecules are present; and degrading the electroconductive molecules through excitation by the excitation beams in the hermetically sealed atmosphere to concurrently form needle-shaped materials on a substrate.

2. The method according to claim 1, wherein the excitation beam consists of a light beam or an ion beam and wherein the method further comprises making said beam uniform and splitting said beam into a plurality of beams.

3. The method according to claim 1, wherein an energy distribution of the excitation beam takes a Gaussian distribution.

4. The method according to claim 1, wherein the excitation beam consists of an electron beam.

5. The method according to claim 1, wherein the excitation beam consists of an ion beam.

6. An apparatus for concurrently manufacturing needle-shaped materials, as deposited materials, on a substrate by degrading electroconductive molecules in a gas atmosphere through excitation by an excitation beam, comprising:

a source for outputting the excitation beam;

splitting means for splitting the excitation beam into a plurality of beams;

focusing means for focusing these beams obtained through splitting; and a chamber in which the electroconductive molecules and substrate can be held therein and where the beams focused by the focusing means are directed onto the substrate to allow needle-shaped materials to be deposited on the substrate.

7. The apparatus according to claim 6, wherein the excitation beam consists of an ion beam and the splitting means has a beam splitting plate with a plurality of through holes through which the ion beam output from the source passes.

8. The apparatus according to claim 6, wherein the excitation beam consists of a light beam wherein the apparatus further comprises optical means for uniformalizing energy distribution of the light beam prior to splitting of the light beam.

9. The apparatus according to claim 8, wherein the splitting means comprises a plate made of a light beam transmissive material and a light shielding film partly provided on the plate.

10. An apparatus for concurrently manufacturing needle-shaped materials, as deposited materials, on a substrate by degrading electroconductive molecules through excitation by an excitation beam, comprising:

a source having a plurality of cathodes to allow electron beams to be output from the respective cathodes;

focusing means for focusing these electron beams output from the cathodes; and a chamber in which the electroconductive molecules are present and the substrate is arranged and into which the electron beams focused by the focusing means are introduced.

11. A method for manufacturing an electric field emission element having a plurality of needle-shaped emitter electrodes on an array substrate, comprising the step of:

splitting an excitation beam into a plurality of beams;

focusing these beams obtained through splitting and directing the beams into a hermetically sealed atmosphere containing electroconductive molecules; and degrading the electroconductive molecules through excitation by the respective beams directed into the hermetically sealed atmosphere and concurrently forming needle-shaped materials, as deposited materials, on the array substrate to provide emitter electrodes.

12. The method according to claim 11, wherein the array substrate and wherein the method further comprises providing comprises a silicon substrate, and wherein the method further comprises providing insulating film on the silicon substrate and providing electroconductive film covering the insulating film, and partly removing the insulating film and electroconductive film by etching to provide cavities where electroconductive molecules can be deposited to form emitter electrodes in one-to-one correspondence to each cavity.

13. The method according to claim 12, further comprising applying voltage to the electroconductive film and depositing the electroconductive molecules via the cavity on the array substrate to provide emitter electrodes.

14. The method according to claim 11, wherein the array substrate comprises a substrate, and wherein the method further comprises providing insulating film on the substrate, and providing electroconductive film covering the insulating film, and providing cavities by partly removing the insulating film and electroconductive film by etching.

15. The method according to claim 14, further comprising assisting formation of a given focusing pattern of the electron beam or ion beam by applying any given voltage to the electroconductive film.

16. The method according to claim 11, wherein the array substrate comprises a silicon substrate and an alternate layer structure of insulating films and electroconductive films, wherein the method further comprises providing cavities in the alternate layer structure by partly removing the insulating films and electroconductive films by etching so that emitter electrodes are formed.

17. The method according to claim 16, further comprising assisting formation of a given focusing pattern by applying given respective voltages to the electroconductive films.

* * * * *